United States Patent [19]

Gmelin et al.

[11] Patent Number: 4,545,353

[45] Date of Patent: Oct. 8, 1985

[54] FUEL INJECTION SYSTEM

[75] Inventors: Karl Gmelin, Ingelfingen; Hans Kubach, Korntal; Wolfgang Maisch, Schwieberdingen; Klaus-Jürgen Peters, Affalterbach; Peter Schelhas, Stuttgart, all of Fed. Rep. of Germany

[73] Assignee: Robert Bosch GmbH, Stuttgart, Fed. Rep. of Germany

[21] Appl. No.: 357,110

[22] Filed: Mar. 11, 1982

[30] Foreign Application Priority Data

Mar. 13, 1981 [DE] Fed. Rep. of Germany ..... 3109560

[51] Int. Cl.[4] ..... F02M 39/00

[52] U.S. Cl. ..... 123/454; 123/452; 137/82

[58] Field of Search ..... 123/454, 452, 453; 335/230, 229; 137/82; 251/129, 141

[56] References Cited

U.S. PATENT DOCUMENTS

| | | | |
|---|---|---|---|
| 2,790,427 | 4/1957 | Carson | 137/82 |
| 3,892,260 | 7/1975 | Lucien | 137/82 |
| 4,381,751 | 5/1983 | Maisch | 123/454 |

*Primary Examiner*—Carl Stuart Miller

*Attorney, Agent, or Firm*—Edwin E. Greigg

[57] ABSTRACT

A fuel injection system is proposed which serves to adapt the fuel-air mixture as precisely as possible to operating conditions of the internal combustion engine. The fuel injection system includes metering valves, each of which is assigned a regulating valve whose movable valve element can be exposed on one side to the fuel pressure downstream of the respective metering valve and on the other side to a control pressure line defined on one end by a control pressure valve of the nozzle/impact plate type and on the other end by a control throttle. The control pressure valve has a permanent magnet and an electromagnet, the magnetic fluxes of which are guided via an armature in such a manner that in at least one air gap the magnetic fluxes of the permanent magnet and of the electromagnet extend in the same direction, while in at least one other air gap the magnetic fluxes of the permanent magnet and of the electromagnet extend in opposite directions. This kind of embodiment requires a substantially smaller triggering power on the part of the electromagnet. By reversing the exciter current of the electromagnet, the control pressure valve is opened widely enough that the control pressure engaging the regulating valves causes the closure of the regulating valves, and the injection of fuel is precluded.

6 Claims, 6 Drawing Figures

FUEL INJECTION SYSTEM

BACKGROUND OF THE INVENTION

The invention is based on a fuel injection system as described by the preamble to the main claim. A fuel injection system is already known in which, in order to control the fuel-air mixture in accordance with operating characteristics of the engine, the pressure difference at the metering valves is variable by exposing regulating valves to the pressure of a pressure fluid in a control pressure line in which an electromagnetic control pressure valve triggerable in accordance with engine operating characteristics is disposed. The control pressure line communicates via a throttle with the fuel supply line of the fuel injection system, in which a pressure limitation valve is disposed in order to regulate the fuel pressure. The disadvantage in this system is that not only is a high triggering output required for the control pressure valve, but also the characteristic curve of the control pressure valve is not amenable to being influenced in the desired manner. A further disadvantage is that interrupting the delivery of fuel during engine overrunning requires additional expenditure of effort.

OBJECT AND SUMMARY OF THE INVENTION

The fuel injection system according to the invention and having the characteristics of the main claim has the disadvantage that for triggering the control pressure valve substantially less triggering output is required, and the characteristic curve of the control pressure valve can be influenced in the desired manner by the appropriate selection of the field intensity of the permanent magnet. A further advantage is that the characteristic curve of the control pressure valve according to the invention begins, where the exciter current is $I=0$, with a finite slope, and emergency operation of the fuel injection system in the case of current failure is possible, because in this case the control pressure valve regulates an average pressure difference. It is also advantageous that the control pressure valve according to the invention does not cause a pressure pulsation.

Advantageous further embodiments of and improvements to the fuel injection system disclosed in the main claim are attainable through the characteristics disclosed in the dependent claims. It is particularly advantageous that by reversing the direction of the exciter current of the electromagnet, the control pressure valve is opened and fuel injection is interrupted; this may occur, for instance, during engine overrunning.

The invention will be better understood and further objects and advantages thereof will become more apparent from the ensuing detailed description of preferred exemplary embodiments taken in conjunction with the drawings.

DESCRIPTION OF THE PREFERRED EMBODIMENTS

Figures 1, 2:
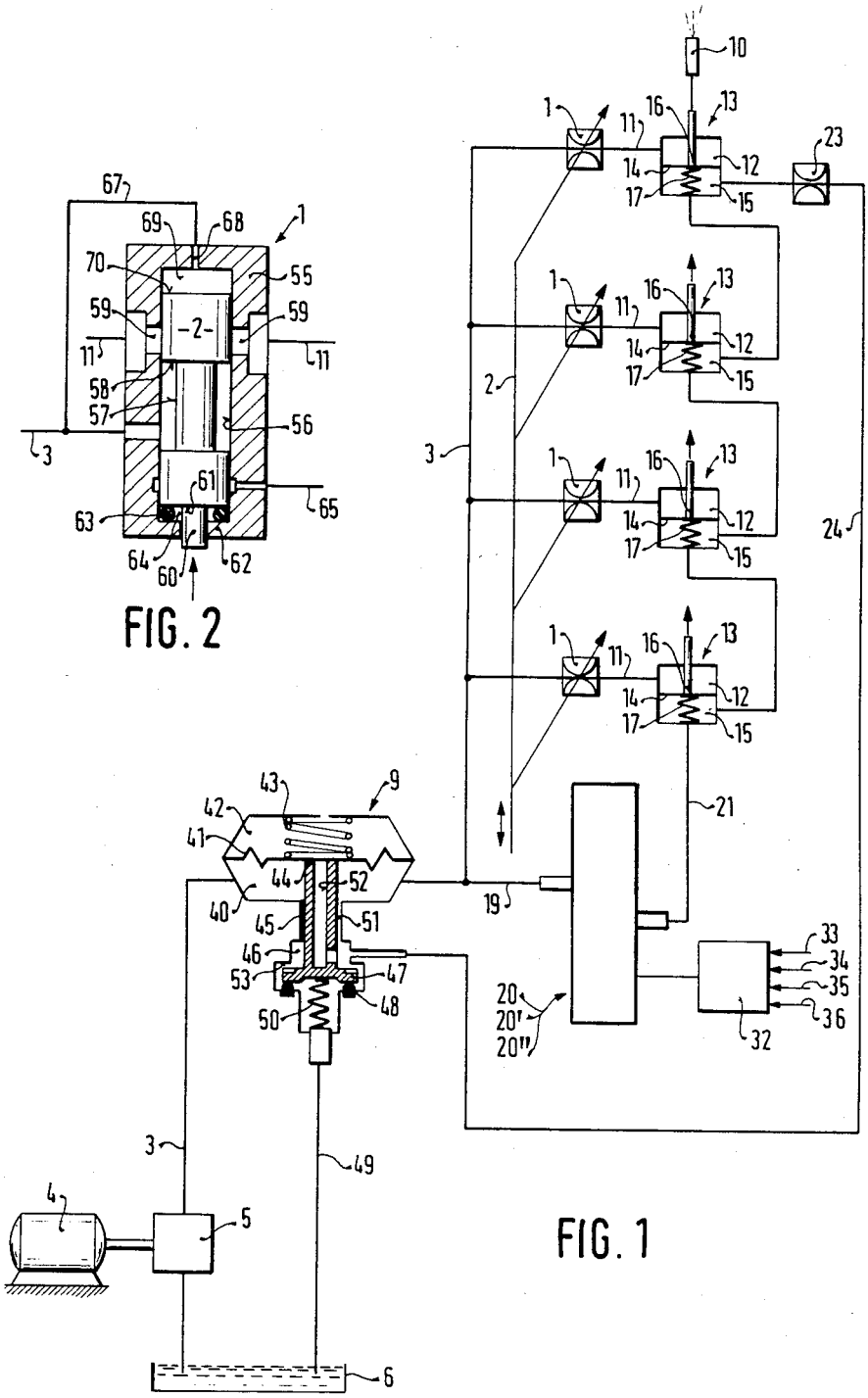
FIG. 1 is a simplified illustration of a fuel injection system having a control pressure valve.
FIG. 2 is a detailed view of a fuel metering valve.

In the exemplary embodiment of a fuel injection system shown in FIG. 1, there are metering valves 1, each cylinder of a mixture-compressing internal combustion engine with externally-supplied ignition being assigned one metering valve 1, at which a quantity of fuel is metered which is at a specific ratio to the quantity of air aspirated by the engine. The fuel injection system shown by way of example has four metering valves 1 and is thus intended for a four-cylinder internal combustion engine. The cross section of the metering valves is variable in common, for instance by means of an actuation element 2 as shown, in accordance with operating characteristics of the engine; for instance, the cross section may be varied in a known manner in accordance with the quantity of air aspirated by the engine. The metering valves 1 are located in a fuel supply line 3, into which fuel is fed from a fuel container 6 by a fuel pump 5 driven by an electromotor 4. A pressure limitation valve 9 is disposed in the fuel supply line 3 and limits the fuel pressure prevailing in the fuel supply line 3; when this pressure is exceeded, the pressure limitation valve 9 causes fuel to flow back into the fuel container 6.

Downstream of each metering valve 1, a line 11 is provided by way of which the metered fuel flows into a regulating chamber 12 of a regulating valve 13 separately assigned to each metering valve 1. The regulating chamber 12 of the regulating valve 13 is separated by a control chamber 15 of the regulating valve 13 by a movable valve element embodied by way of example as a diaphragm 14. The diaphragm 14 of the regulating valve 13 cooperates with a fixed valve seat 16 provided in the regulating chamber 12. By way of this valve seat 16, the metered fuel is able to flow out of the regulating chamber 12 to the individual injection valves 10 (only one of which is shown) in the intake tube of the engine. By means of a closing spring 17 disposed in the control chamber 15, the diaphragm 14 is held against the valve seat 16 when the engine is off.

A line 19 branches off from the fuel supply line 3 and discharges via an electromagnetically actuatable control pressure valve 20, of the nozzle/impact plate type, into a control pressure line 21. Downstream of the control pressure valve 20, the control chambers 15 of the regulating valves 13 are disposed in the control pressure line 21, and downstream from the control chambers 15 there is a control throttle 23. Fuel is capable of flowing out of the control pressure line 21 into a discharge line 24 via the control throttle 23. The control pressure valve 20 is triggered via an electronic control unit 32 in accordance with operating characteristics appropriately entered into it, such as rpm 33, throttle valve position 34, temperature 35, exhaust composition (oxygen sensor) 36 and others. The control pressure valve 20 may be triggered by the electronic control unit 32 in analog or clocked fashion. In the non-excited state of the control pressure valve 20, it can be so dimensioned by means of suitable spring forces or permanent magnets that a pressure difference is established at the control pressure valve 20 and thus assures emergency operation of the engine even if the electronic triggering fails.

The pressure limitation valve 9 has a system pressure chamber 40, which communicates with the fuel supply line 3 and is separated by a valve diaphragm 41 from a spring chamber 42, which communicates with the atmosphere and in which a system pressure spring 43 is disposed which urges the valve diaphragm 41 in the closing direction of the valve. Protruding into the system pressure chamber 40 is a valve seat 44, which cooperates with the valve diaphragm 41 and is supported in an axially displaceable manner on an axial bearing point 45. The end of the valve seat remote from the valve diaphragm 41 protrudes out from the axial bearing point 45 into a collecting chamber 46 and is embodied as a valve plate 47. The valve plate 47 opens or closes a sealing seat 48, which may be embodied as a rubber ring, by way of which fuel can flow into a return-flow line 49 and from there to the intake side of the fuel pump 5, for instance to the fuel container 6. A closing pressure spring 50 supported on the valve plate 47 urges the valve plate 47 in the opening direction and tends to displace the valve seat 44 counter to the force exerted on the valve seat 44 via the valve diaphragm 41. A throttle gap 51 is provided in the axial bearing point 45 of the valve seat 44, between the system pressure chamber 40 and the collecting chamber 46. All the fuel lines discharge into the collecting chamber 46 from the outflow line 24 by way of which the fuel is intended to flow back to the fuel container 6. A conduit 52 is thus provided in the valve seat 44 by way of which fuel can flow into the collecting chamber 46 when the valve diaphragm 41 is lifted up from the valve seat 44. The cross section of the valve plate 47 exposed to fuel is smaller than the valve diaphragm cross section 41, and the elastic sealing seat 48 has approximately the same cross section as the valve plate 47.

The function of the pressure limitation valve 9 is as follows: When the engine is off, the valve plate 47 is seated on the sealing seat 48 and closes the return-flow line 49, while the valve diaphragm 41 closes the valve seat 44. When the engine is started, the fuel pump 5 feeds fuel to the fuel supply line 3 and thus into the system pressure chamber 40 of the pressure limitation valve 9 as well. If this pressure rises above a specific opening pressure at which the force of fuel pressure on the valve diaphragm 41 and the spring force of the closing pressure spring 50 are greater than the spring force of the system pressure spring 43 and the force of fuel pressure on the valve plate 47, then the valve plate 47 lifts up from the sealing seat 48, and the valve seat 44 is displaced in the direction of the valve diaphragm 41. This displacement is limited by a stop 53 at which the valve plate 47 comes to rest. If a specific fuel pressure (system pressure) determined only by the spring force of the system pressure spring 43 is now attained, then the valve diaphragm 41 lifts up from the valve seat 44 and fuel is capable of flowing via the conduit 52 into the collecting chamber 46 and from there into the return-flow line 49. When the engine is shut off or when the fuel supply by the fuel pump is interrupted, the valve diaphragm 41 closes the valve seat 44. The spring forces of the system pressure spring 43 and the closing pressure spring 50 and the cross sections of the valve diaphragm 41 and of the valve plate 47 that are exposed to fuel are all adapted to one another such that fuel is at first capable of flowing via the throttle gap 51 into the collecting chamber 46 and from there via the sealing seat 48 into the return-flow line 49, until the fuel pressure in the fuel injection system is lower than that required for opening the injection valves 10. Only when the fuel pressure drops below the fuel pressure required for opening the injection valves 10 is the valve plate 47 displaced to such an extent counter to the force of the closing pressure spring 50 that it comes to rest on the sealing seat 48, thus blocking off the return-flow line 49. The valve plate 47 is additionally pressed against the sealing seat 48 by the fuel pressure prevailing in the collecting chamber 46. This accordingly prevents fuel leakage out of the fuel injection system, so that when the engine is started again the fuel injection system is ready for operation in the shortest possible time. If the engine is now started again, then the required opening pressure at which the valve plate 47 lifts from the sealing seat 48 is greater than the pressure required for closure, since no equalization of the pressure forces exerted by the fuel pressure in the collecting chamber 46 takes place at the valve plate 47 when it is in the closed state. However, it is desirable to have an opening pressure which is elevated in comparison with the closing pressure, so as to assure reliable closure even if the warming of the fuel enclosed in the system after the engine is shut off causes an increase in the fuel pressure in the fuel injection system.

In FIG. 2, a spool type metering valve 1 is shown in greater detail, having a metering sleeve 55 in which a control slide 2 acting as an actuation element is supported in an axially displaceable manner within a slide bore 56. The control slide 2 has a control groove 57 which is defined on one side by a control edge 58. When an upward displacement occurs, the control edge 58 opens control openings 59 (control slits, for example) to a greater or lesser extent, so that fuel can flow out in a metered fashion to the lines 11 by way of these control openings 59. On its actuation side, the control slide 2 may be engaged at one actuation end 60 in a known manner by an air flow rate meter (not shown), for example, and displaced in accordance with the quantity of air aspirated by the engine. At the transition toward the actuation end 60 having the smaller cross section, a step 61 is formed. The actuation end 60 surrounds a radial wall 62 which it engages and thereby closes the slide bore 56 toward the bottom. An elastic sealing ring 63 is disposed on the radial wall 62; the step 61 comes to rest on this sealing ring 63 in the resting position of the control slide 2, thus sealing it off from the outside. In the operative position of the control slide 2, a leakage space 64 is formed between the step 61 and the radial wall 62; fuel leaking at the outer circumference of the control slide 2 is intercepted at this leakage space 64, and a leakage line 65 leads from it to the collecting chamber 46 of the pressure-limiting valve 9. The force counteracting the actuation force exerted on the actuation end 60 is generated by fuel. To this end, a line 67 branches off from the fuel supply line 3 and discharges via a damping throttle 68 into a pressure chamber 69, into which the control slide 2 protrudes with an end face 70 embodied on the end of the control slide 2 remote from the actuation end 60.

Figure 3:
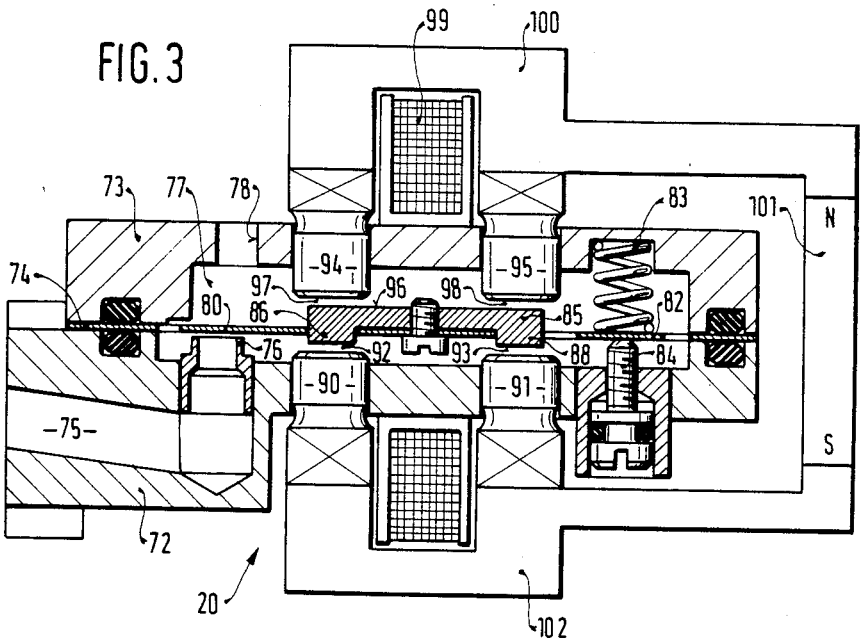
FIG. 3 shows partial elevation and cross-section a first exemplary embodiment of a control pressure valve.
Figure 4:
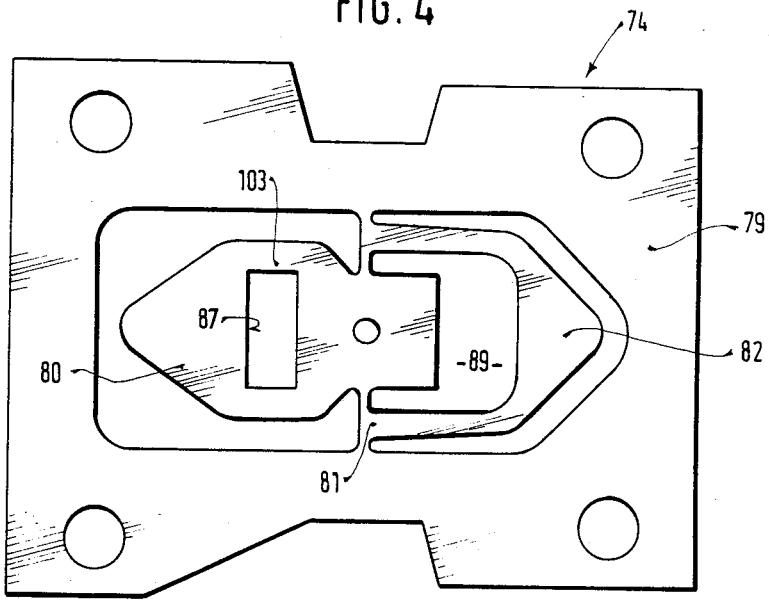
FIG. 4 shows a top plan view of a guide diaphragm of a control pressure valve as shown in FIG. 3.

A first exemplary embodiment of a control pressure valve 20 is shown in FIG. 3. A guide diaphragm 74 is fastened between a lower housing half 72 and an upper housing half 73 and is shown in plan view in FIG. 4. An inlet opening 75 communicates with the line 19 and thus with the fuel supply line 3. The inlet opening 75, via a vertical nozzle 76 acting as a control valve seat, discharges into a work chamber 77 enclosed by the lower housing half 72 and the upper housing half 73. From the work chamber 77, a discharge opening 78 (embodied by way of example in the upper housing half 73) leads to the control pressure line 21. The guide diaphragm 74 has a fastening area 79 fastened between the two housing halves 72, 73. A control area 80 (see FIG. 4) is cut out of the guide diaphragm 74 and is connected on one end with a torsion area 81, while its other end is freely movable. Remote from the control area 80, a spring area 82 also cut out of the guide diaphragm 74 is connected with the torsion area 81. A compression spring 83 (see FIG. 3) is supported at one end on the upper housing half 73 and at the other on the spring area 83, pressing this spring area against an adjusting screw 84, which is threaded into the lower housing half 72 and protrudes into the work chamber 77. An axial adjustment of the adjusting screw 84 causes a corresponding pre-stressing of the spring area 82, as a result of which the control area 80 is pressed to a greater or lesser extent against the nozzle 76 protruding from the lower housing half 72 into the work chamber 77. As a result, it can also be attained that in the case of relatively large regulated pressure differences, an over-proportional ratio exists between the pressure difference and the exciter current of the control pressure valve. Together with the nozzle 76, the control area 80, acting as an impact plate, thus forms a valve of the nozzle/impact plate type. A disc-shaped armature 85 is disposed symmetrically with the torsion area 81 (which forms a torsion axis) and is connected with the control area 80. With an extension 86, the armature 85 thereby passes through an aperture 87 in the control area 81, while a further extension 88 of the armature passes through an aperture 89 on the other side of the torsion area 81. The elastic suspension is virtually friction-free, avoiding hysteresis. A pole shoe 90 is inserted into the lower housing half 72 and protrudes into the work chamber 77, pointing toward the extension 86 of the armature 85, while a second pole shoe 91 is also disposed in the lower housing half 72 and protrudes into the work chamber 77, pointing toward the extension 88 of the armature 85. An air gap 92 is formed between the pole shoe 90 and the extension 86, and an air gap 93 is formed between the extension 88 and the pole shoe 91. In alignment with the pole shoe 90, a pole shoe 94 is disposed in the upper housing half 73, protruding into the work chamber 77, and a pole shoe 95 is disposed in alignment with pole shoe 91 in like manner. An air gap 97 is formed between the pole shoe 94 and the end face 96 of the armature 85 facing it, and an air gap 98 is formed between the pole shoe 95 and the end face 96. An electromagnet coil 99 surrounding the housing halves 72, 73 is disposed between the pole shoes 90 and 91 on the one side and between the pole shoes 94 and 95 on the other. A fork-shaped conductor body 100 surrounds the electromagnet coil 99 and on one end rests on the pole shoes 94, 95 outside the upper housing half 73, while on the other end it rests on a permanent magnet 101, which is engaged at the other end by a conductor body 102 which surrounds the electromagnet coil 99 in fork-like fashion on the lower housing half 72 and engages the pole shoes 90, 91. In the non-excited state of the electromagnet coil 99, a pressure difference is established between the nozzle 76 and the control area 80, in accordance with the tension at the control area 80 which is predetermined via the adjusting screw 84 and the spring area 82; this pressure difference permits sufficient fuel metering for normal operation, or for emergency operation of the engine in case the electronic control unit 32 fails. The conductor bodies 100 and 102 are magnetically polarized by the permanent magnet 101, so that by way of example the magnetic field of the permanent magnet 101 extends on one side from the conductor body 100 via the pole shoe 95, the air gap 98, the armature 85, the air gap 93, and the pole shoe 91 to the conductor body 102, while on the other side it extends via the pole shoe 94, the air gap 97, the armature 85, the air gap 92 and the pole shoe 90 to the conductor body 102. Now, if an exciter current is supplied to the electromagnet coil 99, then an electromagnetic field forms in a particular direction, for instance at on side from the pole shoe 95 via the air gap 98, the armature 85 and the air gap 97 to the pole shoe 94 and on the other side from the pole shoe 91 via the air gap 93 to the armature 85 and via the air gap 92 to the pole shoe 90. The magnetic flux of the electromagnetic field and the permanent field now extends into the air gaps 92 and 98, each in the same direction. In other words, the fluxes are added together, while the magnetic fields of the electromagnet and the permanent magnet extend in the opposite direction into the air gaps 93 and 97, so that these are subtracted from one another. As a result, the extension 86 of the armature 85 is attracted more strongly to the pole shoe 90 and the other end of the armature is attracted more strongly to the pole shoe 95, as a result of which the control area 80 is pivoted about the torsion area 81, closing the nozzle 76 to a greater extent, so that a higher differential pressure is established. The control pressure valve 20 according to the invention has the advantage that by superimposing an electromagnetic circuit on a permanent magnetic circuit, a substantially smaller triggering power is required on the part of the electromagnet. Furthermore, by appropriately weakening or strengthening the permanent magnet 101, the characteristic control curve of the control pressure valve 20 can be influenced in a desired manner, and the characteristic curve of the control pressure valve 20 for an exciter current $I=0$ begins with a finite slope. When the direction of the exciter current is reversed, there is an additional advantage brought about because the control area 80 opens the nozzle 76 so widely that there is virtually no longer any pressure difference at the nozzle 76; as a result, because of the addition of the force of the closing spring 17 and the fuel pressure force in the control chamber 15, the regulating valves 13 close. It is thus possible to attain a desired interruption of fuel injection by reversing the current, at relatively low electrical power for the control pressure valve, in the instance where control signals characterizing engine overrunning are present, such as rpm above the idling rpm and a closed throttle valve.

At the aperture 87 of the guide diaphragm 74, the rim area 103 of the control area 80 may be embodied as so soft that, particularly in the event of wide, regulated pivoting movements of the armature 85 (that is, at large regulated pressure differences), an over-proportional increase in the pressure difference is produced with the exciter current as the result of the increase in magnetic force upon the approach of the armature 85 toward the pole shoes 90, 95.

Figure 5:
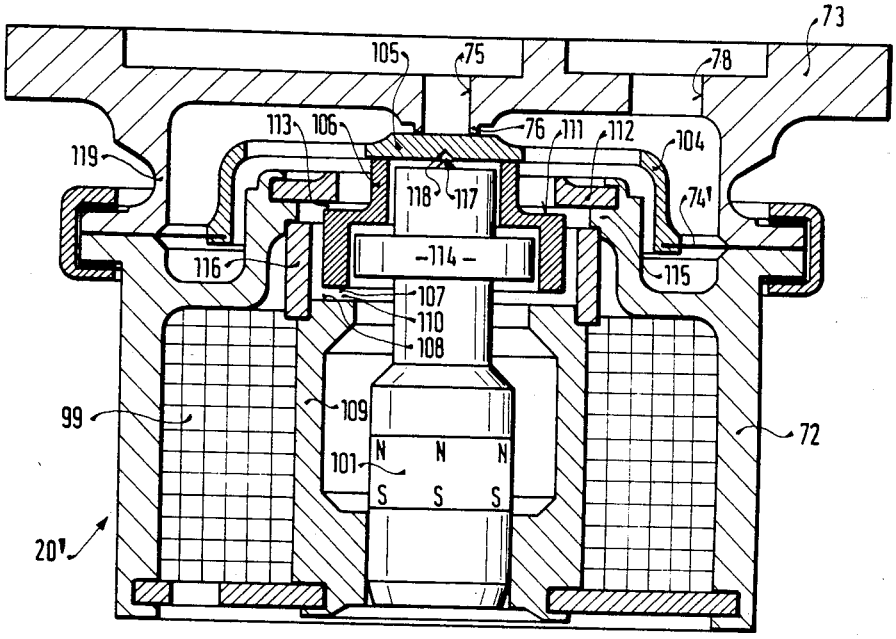
FIG. 5 generally shows a cross-sectional view of a second exemplary embodiment of a control pressure valve.

In the second exemplary embodiment of a pressure control valve 20' shown in FIG. 5, the elements which are identical to and function the same as those of FIG. 3 are given identical reference numerals. Fastened between the lower housing half 72 and the upper housing half 73 is a guide diaphragm 74', with which a guide body 104 of cuplike embodiment is connected, the bottom of the guide body 104 being oriented outwardly toward the nozzle 76 and acting as an impact plate 105. On the other end, a cylindrical armature 106 is connected with the guide body 104, which is axially movable on the guide diaphragm 74'. The plane in which the guide diaphragm 74' is fastened is located approximately in the direction of a radial force acting upon the armature 106. A first air gap 110 is embodied in the axial direction between a first end face 107 of the armature 106 and an end face 108 of a core 109, while a second axial air gap 113 is embodied between a remote, second end face 111 and a conductor piece 112, which is connected at one end with the lower housing half 72 and at the other end protrudes over the second end face 111. The permanent magnet 101 is disposed inside the core 109, protruding with a pole shoe 114 into the armature 106 in such a manner that the magnetic flux of the permanent magnet 101 in the first air gap 110, for example, extends in the opposite direction from the magnetic flux generated by the electromagnet coil 99, while in the second air gap 113, the magnetic flux of the permanent magnet 101 and the magnetic force generated by the electromagnet coil 99 extend in the same direction. An anti-magnetic tube 116 supported at one end on a collar 115 of the lower housing half 72 and at the other end on the core 109 serves to seal off the electromagnet coil 99 from the fuel. A protrusion 117 on the pole shoe 114, embodied as a cone, for example, can engage a corresponding recess 118 of the guide body 104 and serves to guide the armature 106 as centrally as possible. The upper housing half 73 may have a weak point 119, which if there is axial stress on the upper housing half 73 can be axially deformed in order to adjust the gap between the impact plate 105 and the nozzle 76.

The second exemplary embodiment according to FIG. 5 again offers the advantages discussed above in connection with the embodiment of FIG. 3, as the result of the superimposition of an electromagnet system on a permanent magnet system.

Figure 6:
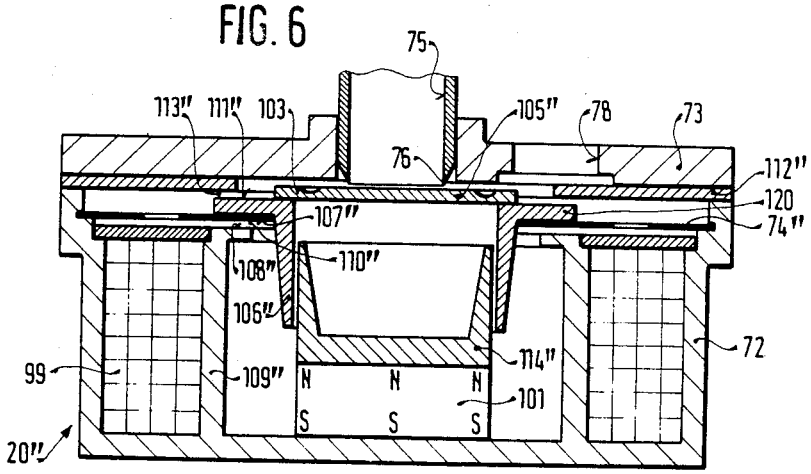
FIG. 6 shows a cross-sectional view of a third exemplary embodiment of a control pressure valve.

In the third exemplary embodiment of a control pressure valve 20'' shown in FIG. 6, the elements remaining the same as and functioning identically to those of the foregoing embodiments are again identified by identical reference numerals. A guide diaphragm 74'' is fastened in the lower housing half 72 such that it is firmly attached to the housing. It is connected with a cylindrical armature 106'' in the central portion thereof, which with a rim 120 protrudes partially over the guide diaphragm 74''. The rim 120 has a first end face 107'', a first air gap 110'' being formed between this first end face 107'' and an end face 108'' of the core 109''. A second end face 111'' is embodied on the rim 120 remote from the first end face 107'', and a second air gap 113'' is formed between the second end face 111'' and a conductor piece 112''. The magnetic flux can reach the lower housing 72 by way of this second air gap 113''. An impact plate 105'' is embodied on the armature 106'' remote from the permanent magnet 101 and cooperates with the nozzle 76. The pole shoe 114'' of the permanent magnet 101 protrudes into the armature 106'' and is embodied such that it tapers toward the armature 106''; while at the same time being substantially saturated magnetically. As a result, when there are eccentricities dictated by tolerances, the radial forces are reduced and the mass of the armature can be minimized.

In accordance with the two foregoing embodiments, the magnetic flux of the permanent magnet 101 in the first air gap 110'', for example, extends in the opposite direction from the magnetic flux generated by the electromagnet coil 99, while in the second air gap 113'' both magnetic fluxes extend in the same direction.

The exemplary embodiment of FIG. 6 has the same advantages as have already been discussed in connection with the two foregoing embodiments.

The forces of the restoring spring upon the armature, on the one hand, and of the permanent magnet on the other, can be adapted to one another in such a manner that the pressure difference regulated by means of the control pressure valves 20, 20', 20'' is theoretically independent of the hydraulic throughput.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel system for mixture-compressing internal combustion engines with externally-supplied ignition, said system further having at least one housing and including metering valves disposed in a fuel supply line for metering a quantity of fuel which is at a specific ratio to the quantity of air aspirated by the engine, said metering operation taking place at a pressure difference which is constant but which can be varied in accordance with operating characteristics of said engine, a regulating valve having a movable valve element disposed downstream of each said metering valve and arranged to regulate the pressure difference at the respective metering valve, said movable valve element further being capable of exposure on one side to the fuel pressure downstream of the respective metering valve and on the other side thereof to the pressure in a control pressure line defined on one end by a control pressure valve triggerable in accordance with operating characteristics of said engine and on the other end by a control throttle, characterized in that said control pressure valve has an impact plate coupled with an armature, said armature further being located within an electromagnetic field and a permanent magnetic field, said electromagnetic field and said permanent magnetic field arranged to extend partially in the same direction and partially in the opposite direction on said armature, said impact plate further arranged to cooperate with a control valve seat which communicates with said fuel supply line, said armature being disc-shaped and connected with a guide diaphragm having a torsion area, said diaphragm attached to said housing, said diaphragm further being rotatably supported about said torsion area of said guide diaphragm, and two pole shoes disposed in pairs at either side of said armature, whereby an air gap is formed between each of said pole shoes and one side of said armature, so that upon a rotation of said armature, one air gap of said pair on either side of said armature is enlarged and the other air gap is reduced in size, and that said guide diaphragm has a control area cut out from a portion of said guide diaphragm, said control area arranged to act as an impact plate and further being rotatable by said armature to a greater or lesser extent relative to said control valve seat.

2. A fuel injection system as defined by claim 1, characterized in that said torsion area of said guide diaphragm is further connected with a spring area which is remote from said control area.

3. A fuel injection system as defined by claim 2, characterized in that said spring area is contacted by an adjusting member.

4. A fuel injection system as defined by claim 1, characterized in that said pole shoes are supported in a conductor body, said conductor body being magnetically polarized by a permanent magnet and arranged to surround said electromagnetic field.

5. A fuel injection system as defined by claim 4, characterized in that the magnetic flux from said electromagnet and permanent magnet on one side of said armature at a time is directed such that in said first air gap between said armature and said one pole shoe, said magnetic flux of said electromagnet and that of said permanent magnet extend in the same direction, while in said other air gap between said armature and said other pole shoe said magnetic flux of said electromagnet and that of said permanent magnet extend in opposite directions.

6. A fuel injection system as defined by claim 1, characterized in that said electromagnetic field includes a reversible exciter current whereby said control pressure valve is opened so widely that as a result of the low pressure difference said regulating valves close.

* * * * *